US010730108B2

(12) United States Patent
Niane et al.

(10) Patent No.: US 10,730,108 B2
(45) Date of Patent: Aug. 4, 2020

(54) DIRECTIONAL SOLIDIFICATION COOLING FURNACE AND COOLING PROCESS USING SUCH A FURNACE

(71) Applicants: Safran Aircraft Engines, Paris (FR); SAFRAN, Paris (FR)

(72) Inventors: Ngadia Taha Niane, Moissy-Cramayel (FR); Serge Alain Fargeas, Moissy-Cramayel (FR); Said Boukerma, Moissy-Cramayel (FR); Serge Tenne, Moissy-Cramayel (FR); Gilles Martin, Moissy-Cramayel (FR)

(73) Assignees: SAFRAN AIRCRAFT ENGINES, Paris (FR); SAFRAN, Paris (FR)

( * ) Notice: Subject to any disclaimer, the term of this patent is extended or adjusted under 35 U.S.C. 154(b) by 104 days.

(21) Appl. No.: 16/313,491

(22) PCT Filed: Jun. 27, 2017

(86) PCT No.: PCT/FR2017/051706

§ 371 (c)(1),
(2) Date: Dec. 27, 2018

(87) PCT Pub. No.: WO2018/002506

PCT Pub. Date: Jan. 4, 2018

(65) Prior Publication Data

US 2020/0180019 A1 Jun. 11, 2020

(30) Foreign Application Priority Data

Jun. 27, 2016 (FR) ..... 16 55959

(51) Int. Cl.
*B22D 27/04* (2006.01)

(52) U.S. Cl.
CPC ..... *B22D 27/045* (2013.01)

(58) Field of Classification Search
CPC ..... B22D 27/045
See application file for complete search history.

(56) References Cited

U.S. PATENT DOCUMENTS

2013/0022803 A1* 1/2013 Schaeffer ..... C30B 29/52 428/220

FOREIGN PATENT DOCUMENTS

CN 105436478 A 3/2016
FR 2 995 807 A1 3/2014
(Continued)

OTHER PUBLICATIONS

International Search Report dated Oct. 17, 2017, in International Application No. PCT/FR2017/051706 (7 pages).

*Primary Examiner* — Kevin P Kerns
*Assistant Examiner* — Steven S Ha
(74) *Attorney, Agent, or Firm* — Bookoff McAndrews, PLLC

(57) ABSTRACT

A directional solidification cooling furnace for metal casting part comprises: a cylindrical internal enclosure having a vertical central axis and a mold support arranged in the internal enclosure; the internal enclosure comprising a casting zone and a cooling zone, the casting zone and the cooling zone being superposed one on the other; the casting and cooling zones being thermally insulated from each other when the mold support is arranged in the casting zone by means of a heat shield that is stationary and by means of a second heat shield that is carried by the mold support; the casting zone including at least a first heating device, and the cooling zone including a second heating device.

9 Claims, 4 Drawing Sheets

(56) References Cited

FOREIGN PATENT DOCUMENTS

| | | | |
|---|---|---|---|
| GB | 2 017 549 | A | 10/1979 |
| JP | 2009-279628 | A | 12/2009 |
| WO | 00/66298 | A1 | 11/2000 |

* cited by examiner

DIRECTIONAL SOLIDIFICATION COOLING FURNACE AND COOLING PROCESS USING SUCH A FURNACE

CROSS-REFERENCE TO RELATED APPLICATIONS

This application is the U.S. national phase entry under 35 U.S.C. § 371 of International Application No. PCT/FR2017/051706, filed on Jun. 27, 2017, which claims priority to French Patent Application No. 1655959, filed on Jun. 27, 2016.

FIELD OF THE INVENTION

The present invention relates to the field of cooling metal parts made by casting, and more particularly to a directional solidification cooling furnace for metal casting part, and also to a method of directional solidification cooling of a metal casting part by making use of such a furnace.

INTRODUCTION

So-called "lost wax" or "investment" casting methods are particularly suitable for producing metal parts of complex shapes. Thus, investment casting is used in particular for producing turbine engine blades.

In investment casting, the first step is to make a model out of a material having a melting temperature that is comparatively low, such as for example a wax or a resin, with a mold then subsequently being overmolded onto the model. After the mold has consolidated, the model material is evacuated from inside the mold. Molten metal is then cast into the mold in order to fill the cavity formed by evacuating the model from the mold. Once the metal has cooled and solidified completely, the mold may be opened or destroyed in order to recover a metal part having the shape of the model.

In order to be able to produce a plurality of parts simultaneously, it is possible to unite a plurality of models in a single cluster, each model being connected to a tree that forms casting channels for the molten metal within the mold.

The term "metal" is used in the present context to cover both pure metals and also metal alloys.

In order to be able to take advantage of the abilities of such metal alloys in obtaining advantageous thermomechanical properties in a part that is produced by casting, it may be desirable to use directional solidification of the metal in the mold.

The term "directional solidification" is used in the present context to cover controlling the seeding of solid crystals and their growth in a given direction within the molten metal as it goes from the liquid state to the solid state. The purpose of such directional solidification is to avoid the negative effects of grain boundaries in the part. Thus, directional solidification may be columnar or monocrystalline. Columnar directional solidification consists in orienting all of the grain boundaries in the same direction so as to reduce their contribution to crack propagation. Monocrystalline directional solidification consists in ensuring that the part solidifies as a single crystal, so as to eliminate grain boundaries.

Not only may parts produced by directional solidification achieve particularly high mechanical strength along all force axes, but they may also have improved high-temperature performance, since there is no need to use additives for achieving stronger bonding between the crystal grains. Thus, metal parts produced in that way may be used advantageously in the hot portions of turbines, for example.

In directional solidification casting methods, a liquid metal is cast into a mold comprising a central cylinder that extends along a main axis between a casting bush and a base, together with a plurality of molding cavities arranged as a cluster around the central cylinder, each cavity being connected to the casting bush by a feed channel. After the molten metal has been cast into the mold cavities via the casting bush, the molten metal is cooled progressively along said main axis from the base towards the casting bush. By way of example, this may be done by extracting the mold progressively from a furnace or a heating chamber downwards along its main axis while cooling the base.

Because the molten metal is cooled progressively starting from the base, solidification of the metal may begin in the proximity of the base and may extend therefrom along a direction parallel to the main axis.

Nevertheless, during solidification and cooling of the metal, large temperature gradients may exist between the various portions of the mold and the metal, thereby giving rise to distortions and to thermomechanical stresses in the part. In order to limit those stresses, a cooler made of copper and enabling a cooling zone to be maintained at a temperature of about 300° C. is used in order to reduce the temperature gradient that exists in the part during directional solidification.

Nevertheless, since the parts that are presently being produced are becoming ever more complex (new alloys, hollow or solid turbine blades and/or ever finer wall thicknesses), the thermomechanical stresses that arise may lead to re-crystallized grains and cracks forming during solidification and cooling of those blades, thereby leading to zones of weakness in the final part.

SUMMARY OF THE INVENTION

The present disclosure provides a directional solidification cooling furnace for metal casting part, the furnace comprising:

- a cylindrical internal enclosure having a vertical central axis; and
- a mold support arranged in the internal enclosure; the internal enclosure comprising:
- a casting zone; and
- a cooling zone, the casting zone and the cooling zone being superposed one on the other;
- the casting and cooling zones being thermally insulated from each other when the mold support is arranged in the casting zone by means of a heat shield that is stationary and by means of a second heat shield that is carried by the mold support;
- the casting zone including at least a first heating device, and the cooling zone including a second heating device, the first and second heating devices being configured so that the temperature of the casting zone is higher than the temperature of the cooling zone; and
- the cooling zone including an upper portion and a lower portion that are superposed one on the other and that are thermally insulated from each other by a third heat shield, the upper portion of the cooling zone including the second heating device.

In the present disclosure, the term "cylindrical" should be understood as meaning that the wall of the furnace defining the internal enclosure has a section of arbitrary shape in a plane perpendicular to the central vertical axis of the furnace, which shape may be circular, square, or hexagonal. Nevertheless, the shape of the furnace could equally well present a section that is generally oblong.

The mold support may be a plate that can move vertically along the central axis of the furnace and that is suitable for supporting the mold in which the liquid metal is to be cast.

In the present disclosure, the "casting zone" designates the zone of the internal enclosure of the furnace in which the liquid metal is cast into the mold. The mold support is then positioned in the lower portion of this casting zone or else between the casting zone and the cooling zone, such that the mold when placed on the mold support is likewise arranged in this zone.

In the present disclosure, the "cooling zone" designates the zone of the internal enclosure of the furnace that is positioned vertically beneath the casting zone and in which the liquid metal present in the mold after casting gradually cools and solidifies, once the mold is positioned in this cooling zone.

In the present disclosure, the terms "above", "below", "upper", "lower", "under" are defined relative to the direction metal is cast into the mold under the effect of the force of gravity, i.e. relative to the normal orientation of the mold and of the cooling furnace while metal is being cast into the mold.

The casting and cooling zones include respective first and second heating devices such that the temperature of the casting zone is higher than a temperature of the cooling zone. The fact that the temperature of the cooling zone is lower than a temperature of the casting zone enables the metal in the mold to pass progressively from the liquid state to the solid state.

These two zones are thermally insulated from each other by a first heat shield that is stationary and that may be arranged in the wall of the furnace, and by a second heat shield that is carried by the mold support when it is arranged in the casting zone, enabling the temperature of each zone to be controlled more accurately without being subjected to the influence of the temperature of the neighboring zone.

Regulating the heating devices, and thus the temperatures of the casting and cooling zones serves to control the temperatures, the rate of cooling, and thus the temperature gradients during cooling of the metal, thereby limiting thermomechanical stresses and plastic deformation in the metal.

The upper portion of the cooling zone including the second heating device serves to control temperature gradients in the metal during directional solidification. The third heat shield may be arranged in the wall of the furnace. The upper portion of the cooling zone is thus thermally insulated from the casting zone by the first and second heat shields, and from the lower portion of the cooling zone by the third heat shield, thereby enabling the temperature of this zone to be regulated more accurately, without it being subjected to the influence of the temperatures in the neighboring zones.

In certain embodiments, the upper portion of the cooling zone is removable.

The term "removable" should be understood as meaning that the upper portion of the cooling zone may be separated from the remainder of the furnace. It is thus possible to adapt the second heating device as a function of the type of alloy used for the metal casting, and thus as a function of the temperature gradients that are to exist in the casting during directional solidification. In particular it is possible to replace this portion in order to go back to using the prior art copper cooler, where appropriate. This presents the advantage of providing a wide range of possible alloys and shapes for the cast metal part, since the furnace may be adapted as a function of these various types of alloy, and also presents the advantage of providing maintenance that is simple and fast for operators.

In certain embodiments, the second heating device comprises an induction susceptor.

In certain embodiments, the second heating device comprises an electrical resistance.

In certain embodiments, the internal enclosure has a diameter greater than or equal to 20 centimeters (cm), preferably greater than or equal to 50 cm, more preferably greater than or equal to 80 cm.

This makes it possible to improve the effectiveness of the process for fabricating metal castings, by making it possible to use clusters of larger size, having a larger number of castings, or castings of shapes that are complex and that occupy a larger volume.

In certain embodiments, the casting zone has an upper portion and a lower portion that are thermally insulated from each other by a fourth heat shield, the upper portion including an upper heating device and the lower portion including a lower heating device.

In certain embodiments, the upper and lower heating devices of the casting zone are configured so that the temperature of the upper portion is higher than or equal to the temperature of the lower portion.

In certain embodiments, the upper and lower heating devices of the casting zone are configured so that the temperature of the narrow portion is higher than or equal to the temperature of the upper portion.

This makes it possible to control temperatures in the casting zone, and to adapt the temperatures of the upper and lower portions of the casting zone as a function of the type of cluster and of the type of alloy under consideration. Consequently, this makes it possible to control temperature gradients in the direction of directional solidification, and to control cooling time.

The present disclosure also provides a method of directional solidification cooling of a metal casting using the furnace of the present disclosure, the method comprising the steps of:

- fastening the upper portion of the cooling zone on the furnace;
- adjusting the casting zone to a casting temperature and the cooling zone to a cooling temperature, the temperature of the upper portion of the cooling zone being higher than or equal to 700° C.;
- progressively cooling the cast metal part by moving the mold support inside the furnace from the casting zone towards the cooling zone.

During the directional solidification, while the mold is moving downwards in the vertical direction, the mold, arranged on the cluster support, passes progressively from the casting zone to the cooling zone. This method makes it possible firstly to adapt the upper portion of the cooling zone as a function of the type of cluster and of the type of alloy under consideration, and secondly to adjust the temperatures of the various zones to values that enable the metal of the metal part to be cooled by directional solidification by controlling the temperature gradients within the part, and consequently limiting the risk of recrystallized grains appearing and thus the risk of defects or points of weakness appearing in the part.

In certain implementations, the temperature difference between the casting zone and the liquid metal lies in the range 0° C. to 50° C., the temperature of the casting zone being lower than the temperature of the liquid metal.

When the mold is positioned in the casting zone, the fact of not exceeding this temperature difference makes it possible to conserve the metal in the liquid state so that all of the metal present in the mold remains in the liquid state throughout the casting stage. This makes it possible to avoid the presence of metallurgical defects that might otherwise appear in the event of solidification not being properly controlled.

In certain implementations, the temperature of the upper portion of the cooling zone is greater than or equal to 700° C., preferably greater than or equal to 800° C., more preferably greater than or equal to 900° C.

Controlling the temperature in this furnace to have these values makes it possible during directional solidification to cause the metal to pass from the liquid state to the solid state while limiting temperature gradients within the cluster. This makes it possible to obtain cooling that is more progressive and slower, thus limiting any risk of recrystallized grains appearing, and thus controlling stresses and deformation in the casting.

In certain implementations, during cooling of the metal casting, the cooling rate at a given point of the metal casting is less than −0.30 degrees Celsius per second (° C./s), preferably less than or equal to −0.25° C./s, and greater than −0.10° C./s, preferably greater than or equal to −0.15° C./s.

The rates of cooling have values that are negative. Specifically, by way of example, a cooling rate of −0.30° C./s means that during cooling, the temperature at a given point in the metal casting reduces by 0.30° C. every second. Consequently, the term "less than −0.30° C./s" should be understood as a rate of cooling that is slower, such that these values should be considered in terms of absolute value. For example, −0.25° C./s is a rate of cooling that is less than −0.30° C./s.

These cooling rates serve to reduce the temperature gradients within the casting by providing better control over its cooling, and thus limiting any risk of recrystallized grains and defects appearing in the casting.

BRIEF DESCRIPTION OF THE DRAWINGS

The invention and its advantages may be better understood on reading the following detailed description of various embodiments of the invention given as non-limiting examples. This description refers to the accompanying sheets of figures, in which.

DETAILED DESCRIPTION OF EMBODIMENTS

Figure 1:
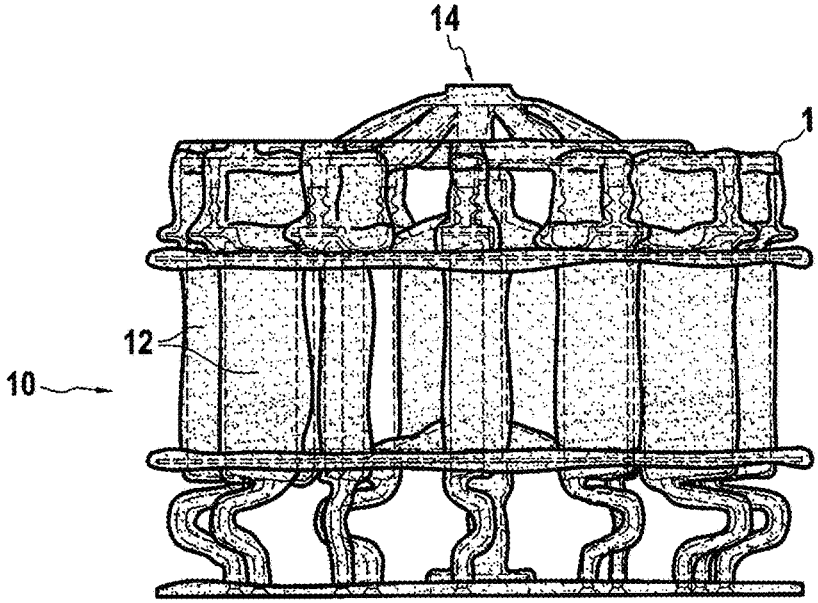
FIG. 1 is a side view of a shell mold including a casting cluster.

An example furnace 20 of the present disclosure and an example cooling method by directional solidification for use with blades made by casting are described below with reference to FIGS. 1 to 5.

Blades are fabricated by a casting method. A first step in this casting method consists in fabricating a model of the blades and in grouping together a plurality of models so as to form a cluster enabling a mold to be fabricated, as described in the following step.

In a second step, a shell mold 1 is fabricated from the wax cluster.

The last operation of the second step consists in eliminating the wax of the cluster model from the shell mold 1. Wax is eliminated by raising the shell mold 1 to a temperature higher than the melting temperature of the wax.

In a third step, a cluster 10 of blades 12 (FIG. 1) is formed in the shell mold 1 by casting molten metal into the shell mold 1. Molten metal is cast into the shell mold 1 from the top portion of the mold, referred to as a casting bush 14. During this step, the shell mold 1 is in a casting zone A of a cooling furnace 20.

In a fourth step, the metal present in the shell mold is cooled and its solidifies in a cooling zone B of the cooling furnace 20.

Finally, in a fifth step, after the cluster 10 has been released from the shell mold 1 by a knocking-out method, each of the blades 12 is separated from the remainder of the cluster 10 and is finished by completion methods, e.g. machining methods.

The invention relates in particular to the cooling furnace 20 and to the method of solidification performed during the fourth step described above.

Figure 2:
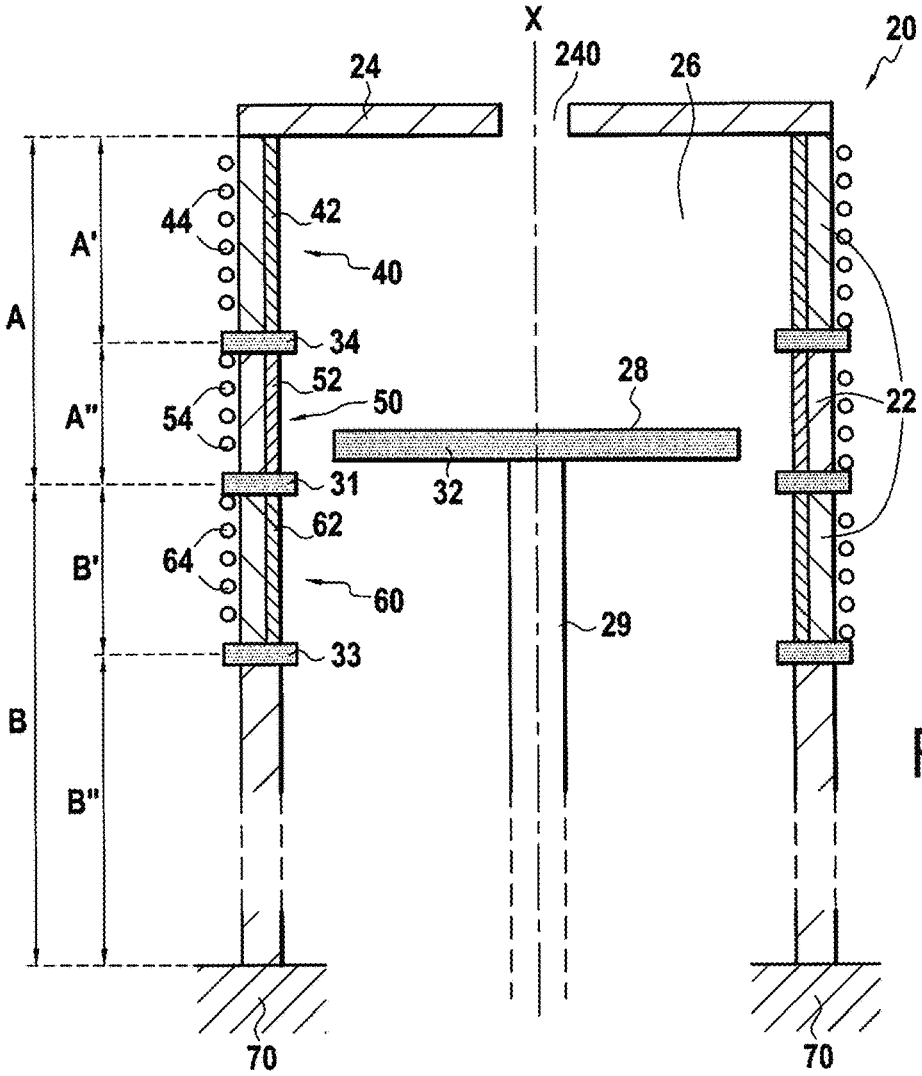
FIG. 2 is a diagrammatic section view of a cooling furnace.

This solidification method, referred to as "directional solidification" is performed by means of the furnace 20 (FIG. 2).

The furnace 20 has a cylindrical wall 22 with a vertical central axis X, and a top wall 24 arranged at the top end of the cylindrical wall 22, perpendicularly to the axis X, so that the cylindrical wall 22 and the top wall 24 form an internal enclosure 26 of the furnace. The top wall includes an orifice 240 positioned substantially in the center of the wall 24.

The furnace is made up of a casting zone A and a cooling zone B that are superposed one on the other so that the casting zone A is above the cooling zone B. The casting and cooling zones A and B are thermally insulated from each other by a first heat shield 31, which may be made of a material that is not thermally conductive and that is inserted in the wall 22. For example, the first heat shield 31 may be made of compressed graphite paper or of a sandwich comprising a layer of felt compressed between two layers of graphite possessing emissivity in the range 0.4 to 0.8 as a function of temperature (e.g. as sold under the name PAPYEX®.).

The furnace 20 also has a horizontal mold support 28 arranged inside the internal enclosure 26 and fastened on a jack 29 that serves to move the support 28 vertically upwards or downwards. The mold support 28 includes a second heat shield 32 so that when the mold 1 is positioned on the mold support 28, the mold 1 is thermally insulated from the remainder of the internal enclosure 26 that is situated under the second heat shield 32. Thus, when the mold 1 is in the casting zone A, it is thermally insulated from the cooling zone B by the first heat shield 31 and the second heat shield 32.

Furthermore, the cooling zone B itself has an upper portion B' and a lower portion B", the upper and lower portions B' and B" being superposed one on the other so that the upper portion B' is arranged above the lower portion B". The upper and lower portions B' and B" are thermally insulated from each other by a third heat shield 33. The upper portion B' also has a heating device 60 comprising a susceptor 62 and a heating coil 64. The lower portion B" constituting the bottom portion of the furnace 20 is connected to a stand 70.

The upper portion B' of the cooling zone B is removable. The heating device 60 is thus adapted as a function of the parts that need to be cooled, of their dimensions, of their alloys. This also makes it possible to simplify and facilitate maintenance operations for operators.

The casting zone A also has an upper portion A' and a lower portion A", the upper and lower portions A' and A" being superposed one on the other such that the upper portion A' is arranged above the lower portion A". The upper and lower portions A' and A" are thermally insulated from each other by a fourth heat shield 34. The upper portion A' includes a heating device 40 comprising a susceptor 42 and a heating coil 44. The susceptor 42 may be a graphite tube arranged inside the internal enclosure 26 so as to be pressed against the wall 22 of the furnace 20. The heating coil 44 may be a copper coil surrounding the outer wall 22, serving to create a magnetic field that has the effect of heating the susceptor 42. The susceptor thus also heats the internal enclosure 26 by radiation. Furthermore, the internal enclosure 26 may be evacuated, so as to preserve the graphite susceptor from any oxidation. Alternatively, the internal enclosure 26 may also be partially evacuated with an inert gas, e.g. argon, being present.

The lower portion A" also has a heating device 50 comprising a susceptor 52 and a heating coil 54, the hater device 50 of the lower portion A" being distinct from the heating device 40 of the upper portion A', so as to be able to heat the portions independently of each other, and thereby control the temperature gradient within the internal enclosure 29 in the casting zone A.

In the present example, the inside diameter of the cylindrical wall lies in the range 200 millimeters (mm) to 1000 mm. The casting zone extends vertically over a height of 1 meter (m). These dimensions make it possible to work with clusters of larger size, including a larger number of blades of height that may lie in the range 200 mm to 300 mm. The removable upper portion B' extends vertically over a height lying in the range 150 mm to 300 mm.

There follows a description of a method of cooling metal cast blades by directional solidification using the above-described furnace.

Firstly, the upper portion B' of the cooling zone is fastened to the furnace 20.

Figure 3B:
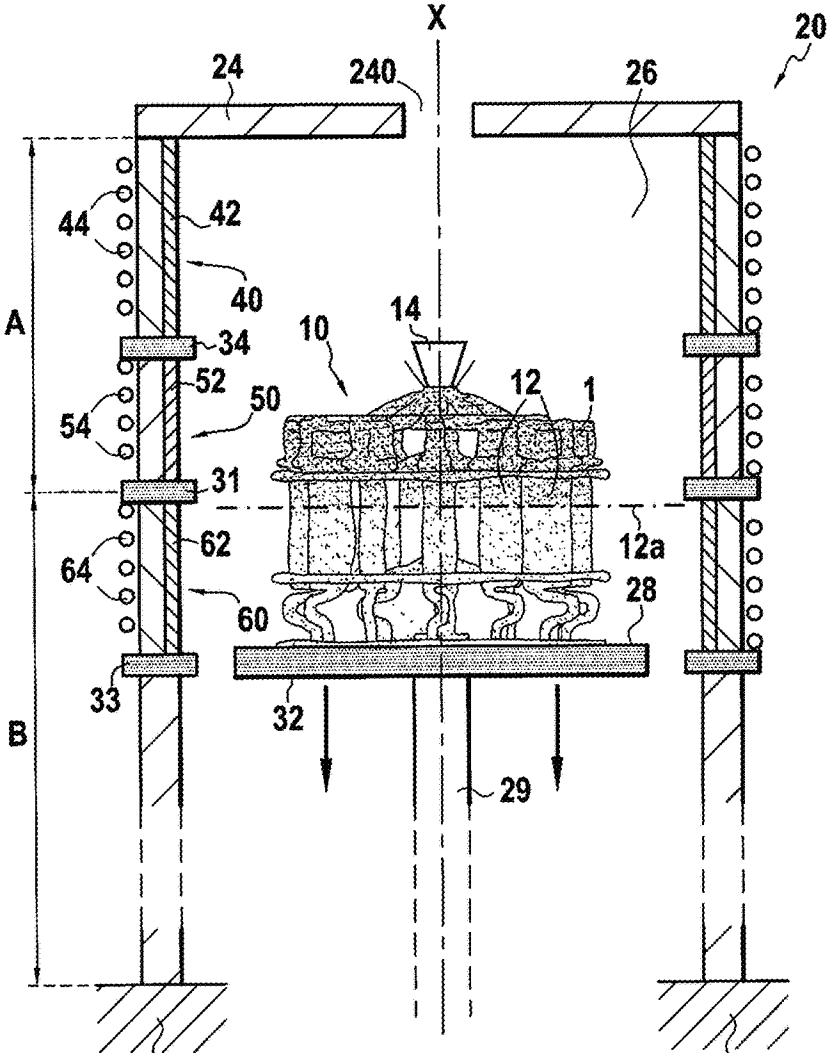
FIG. 3B is a diagrammatic section view of the furnace and of the mold during directional solidification.
Figure 3A:
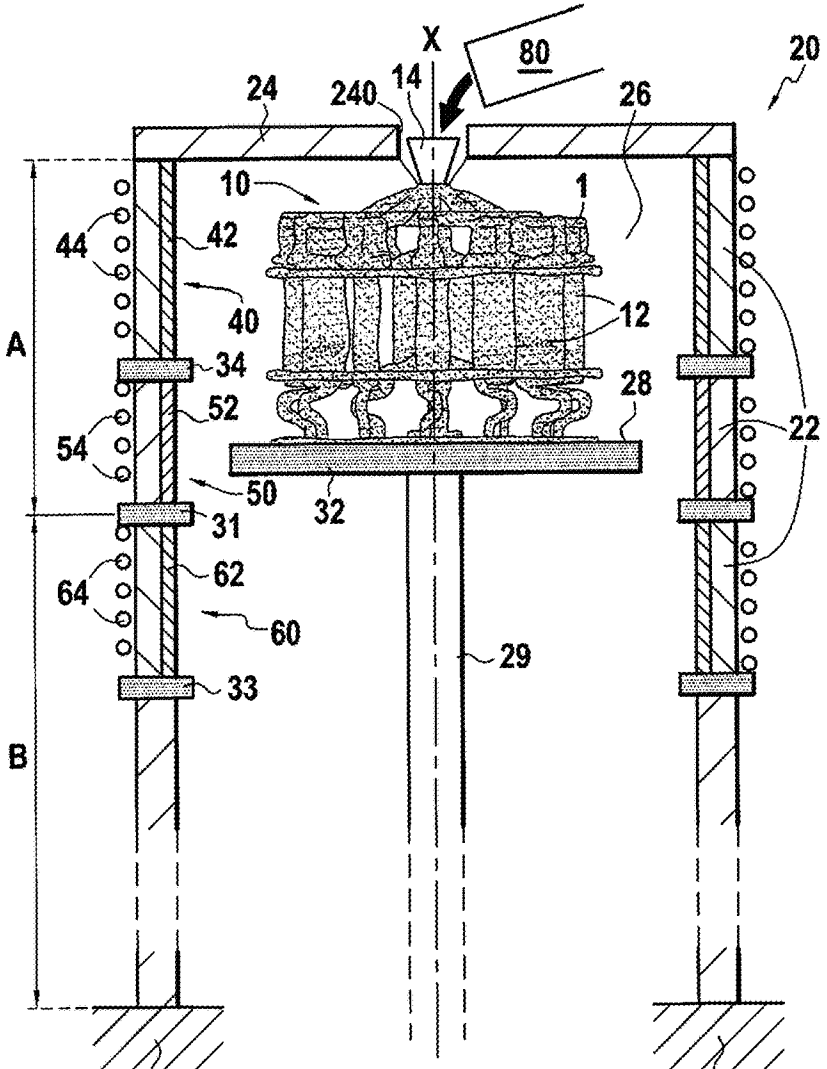
FIG. 3A is a diagrammatic section view of the FIG. 2 furnace, the FIG. 1 mold being arranged in the casting zone.

Beforehand, a casting step, as shown in FIG. 3A, consists in placing the mold 1 in the casting zone A and in positioning it on the support 28, which is itself situated in the casting zone A. The mold 1 is positioned in such a manner that the casting bush 14 faces the orifice 240 in the top wall 24 of the furnace 20. Metal in the liquid state at a temperature lying in the rang 1480° C. to 1600° C. and contained in a crucible 80 is then poured into the bush 14 via the orifice 240 until the mold 1 is almost completely filled, the casting bush 14 being filled in part only.

In parallel with this casting step, the heating devices 40 and 50 are adjusted so as to heat the mold 1 by thermal radiation so as to keep it at a temperature lying in the range 1480° C. to 1600° C. The temperature of the casting zone is thus less than or equal to the temperature of the liquid metal, the difference lying in the range 0° C. to 50° C. Thus, the temperature of the liquid metal cast into the mold 1 remains higher than the melting temperature of the metal so as to avoid unwanted solidification in the mold 1 throughout the entire casting step. Furthermore, the mold 1 is thermally insulated from the cooling zone B by the first and second shields 31 and 32.

Once the casting step has finished, i.e. when the mold 1 is completely filled with liquid metal, with the exception of the layer of metal that has already solidified and that is in contact with the bottom of the mold, and after a stage of waiting prior to lowering the support, the solidification stage begins.

The support 28 is then moved downwards by the jack 29 so that the mold passes little by little from the casting zone A to the cooling zone B' (FIG. 3B). The temperature in this zone is then set to a temperature of 700° C. or higher than 700° C., while being lower than the melting temperature of the metal so as to cause the metal to solidify, while the casting zone A continues to be maintained at a temperature in the range 1500° C. to 1530° C. Since the lower portion of the mold 1 is the first to penetrate into the cooling zone, the liquid metal thus begins to solidify in this lower portion of the mold. A solidification front is thus created as represented symbolically by a line 12*a* in FIG. 3B, which front corresponds to the interface between the liquid and solid phases of the metal. This solidification front 12*a* moves upwards in the reference frame of the mold 1 as the mold penetrates progressively into the cooling zone B, on the principle of directional solidification. Thus, as the support 28 continues to move downwards, the mold 1 ends up having its full height located in the bottom portion B" of the cooling zone, such that all of the metal present in the mold 1 is in the solid state. The solidification stage has thus finished. The total duration of the cooling method may for example lie in the range 3600 seconds (s) to 7600 s, with the support 28 moving at a speed lying in the range 1 millimeter per second (mm/s) to 10 mm/s.

The blades 12 that are obtained are blades that are monocrystalline and hollow or solid, and made of nickel-based alloys. The term "nickel-based alloy" it used to designate alloys in which the weight content of nickel is in the majority. It may be understood that nickel is thus the element having the weight content in the alloy that is the greatest. These more fragile hollow or solid blades may present defects if the temperature gradients are not properly controlled during the cooling and the solidification. The above described furnace and method, and in particular the removable portion B' serve to limit or even eliminate these risks by setting the temperature of this portion to a temperature that is high enough (higher than or equal to 700° C.) to minimize the temperature gradients that exist in the blades 12 in the direction of directional solidification, i.e. when the mold 1 is situated both in the casting zone A and in the cooling zone B.

Figure 4:
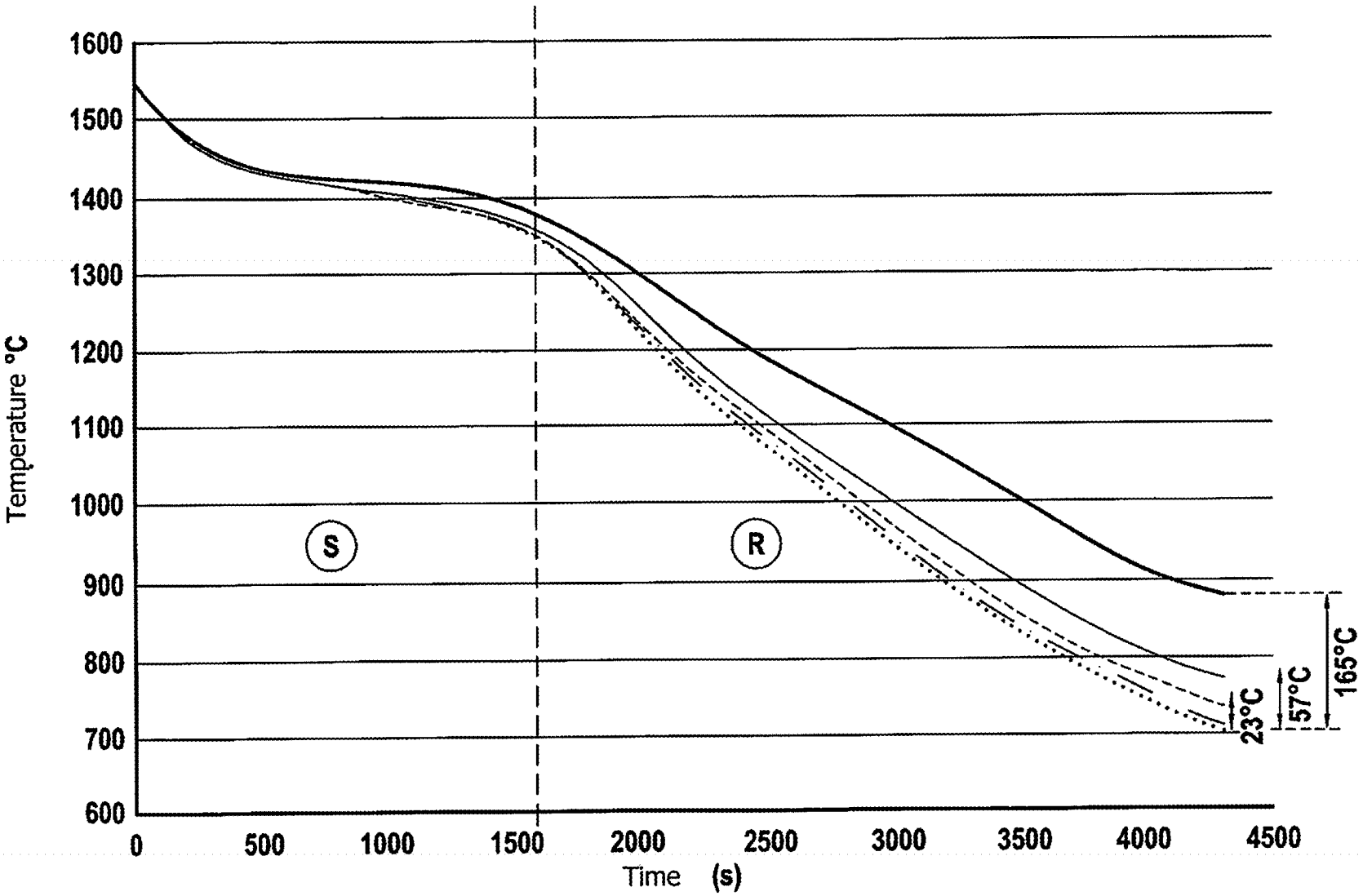
FIG. 4 is a graph showing how temperature varies at a point of a part for varying temperature of the removable portion.

FIG. 4 shows how the temperature varies at a point on the leading edge of a blade 12 for varying temperatures of the removable portion B' during the solidification stage (S) and during the cooling stage (R). The dotted-line curve shows the reference situation using a copper cooler serving to maintain a cooling zone at a temperature of about 300° C., the continuous fine-line curve shows a situation using the furnace when the removable portion B' is heated to 700° C., and the continuous bold-line curve shows the situation when the removable portion B' is heated to 1000° C. The other curves show intermediate situations.

Although the differences between each configuration are little marked during the solidification stage, the influence of the removable portion is particularly visible during the cooling stage, starting from 700° C. For that temperature, the rate of cooling, corresponding to the slope of the curve, is −0.23° C./s such that the temperature at this point is 57° C. higher than in the reference situation. For the removable portion at a temperature of 1000° C., the rate of cooling is −0.18° C./s, such that the temperature at this point is 165° C. higher than in the reference situation. These lower rates of cooling give rise to temperature gradients that are lower, and thus to stresses that are likewise lower in the metal casting during cooling.

Figure 5:
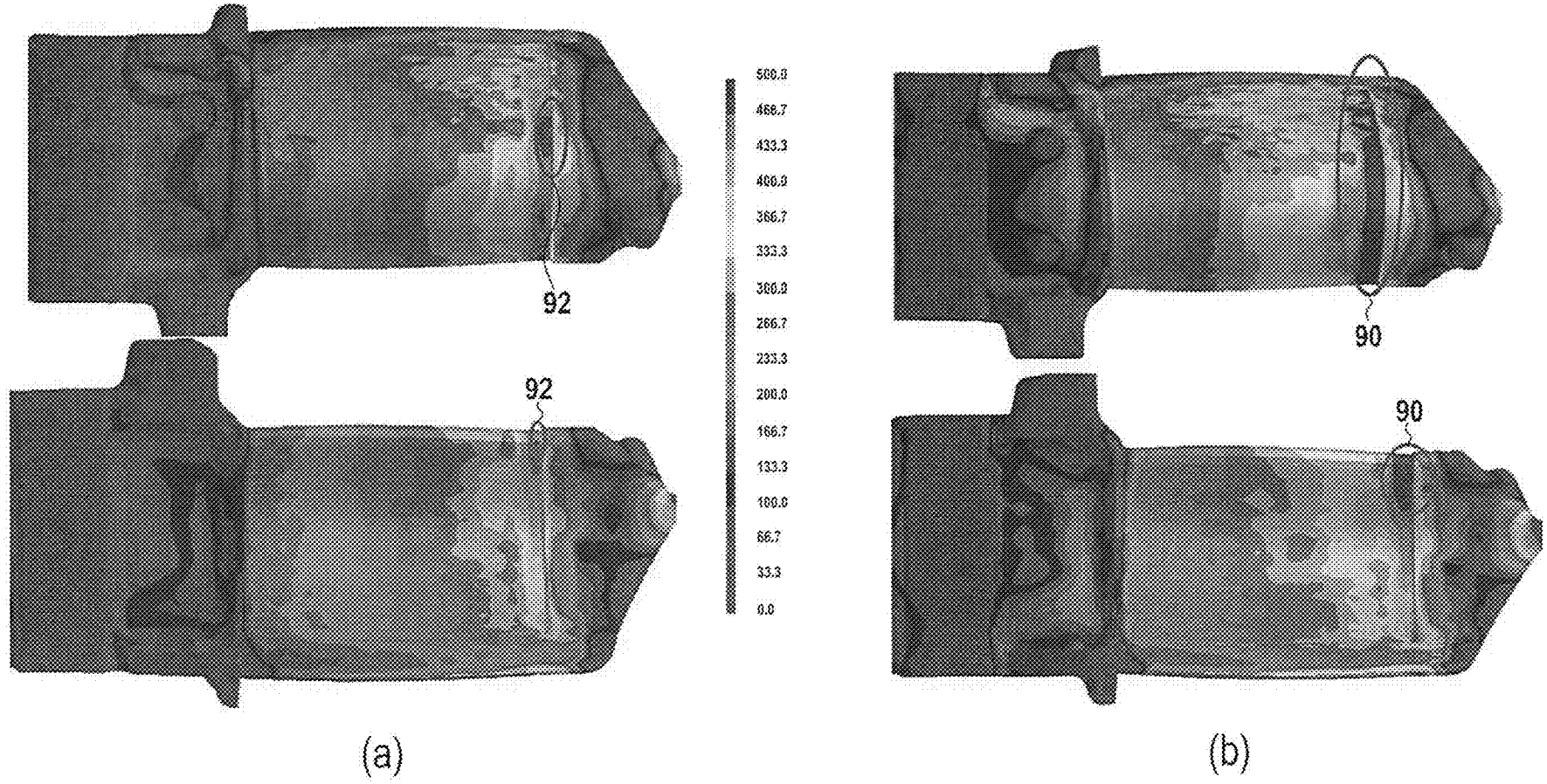
FIG. 5 shows the thermal stresses in a metal part, comparing the use of a conventional furnace with the use of an furnace in accordance with the present disclosure.

Furthermore, FIG. 5 shows thermal stresses in the metal of a blade by comparing the use of a conventional furnace (blades (b) on the right of FIG. 5) and an furnace of the present disclosure (blades (a) on the left in FIG. 5). The upper and lower blades show respectively the two main faces of a single blade. In FIG. 5, for the blades (b) corresponding to the conventional furnace, the zones 90 indicate zones of the blade where the stresses were the greatest. For the blades (a) corresponding to the furnace of the present disclosure, the zones 92 show zones of the blade where the stresses were the greatest. It may thus be seen that the zones 92 extend over a smaller area of the blade than do the zones 90, such that the stresses are smaller in blades cooled by the furnace 20 of the present disclosure than in a conventional furnace. More precisely, the stresses in the metal may be reduced by about 24% by means of the furnace 20 and the method of the present disclosure.

Although the present invention is described with reference to specific embodiments, it is clear that modifications and changes may be made to those embodiments without going beyond the general ambit of the invention as defined by the claims. In particular, individual characteristics of the various embodiments shown and/or mentioned may be combined in additional embodiments. Consequently, the description and the drawings should be considered as being illustrative rather than restrictive. For example, the cooling zone may have two heating devices superposed one on the other.

It is also clear that all of the characteristics described with reference to a method may be transposed, singly or in combination, to a device, and vice versa, all of the characteristics described with reference to a device may be transposed, singly or in combination, to a method.

The invention claimed is:

1. A directional solidification cooling furnace for a metal casting part, the furnace comprising:

a cylindrical internal enclosure having a vertical central axis; and a mold support arranged in the internal enclosure;

the internal enclosure comprising:

a casting zone; and a cooling zone, the casting zone and the cooling zone being superposed one on the other;

the casting and cooling zones being thermally insulated from each other when the mold support is arranged in the casting zone by means of a first heat shield that is stationary and by means of a second heat shield that is carried by the mold support;

the casting zone including at least one heating device, and the cooling zone including a first heating device, the furnace being configured so that the temperature of the casting zone is higher than the temperature of the cooling zone; and the cooling zone including an upper portion and a lower portion that are superposed one on the other and that are thermally insulated from each other by a third heat shield, the upper portion of the cooling zone including the first heating device.

2. A furnace according to claim 1, wherein the upper portion of the cooling zone is removable.

3. A furnace according to claim 1, wherein the first heating device of the cooling zone comprises an induction susceptor.

4. A furnace claim 1, wherein the first heating device of the cooling zone comprises an electrical resistance heater.

5. A furnace according to claim 1, wherein the internal enclosure has a diameter greater than or equal to 20 cm.

6. A furnace according to claim 1, wherein the casting zone has an upper portion and a lower portion that are thermally insulated from each other by a fourth heat shield, the upper portion including an upper heating device and the lower portion including a lower heating device.

7. A method of directional solidification cooling of a metal casting part using the furnace according to claim 1, the method comprising the steps of:

fastening the upper portion of the cooling zone on the furnace;

adjusting the casting zone to a casting temperature and the cooling zone to a cooling temperature, the temperature of the upper portion of the cooling zone being higher than or equal to 700° C.; and progressively cooling the metal casting part by moving the mold support inside the furnace from the casting zone towards the cooling zone.

8. A method according to claim 7, wherein the temperature difference between the casting zone and the liquid metal lies in the range greater than 0° C. to 50° C., the temperature of the casting zone being lower than the temperature of the liquid metal.

9. A method according to claim 7, wherein during cooling of the metal casting part, a cooling rate at a given point of the metal casting part is less than −0.30° C./s.

* * * * *